US005819647A

United States Patent [19]

Balosh

[11] Patent Number: 5,819,647

[45] Date of Patent: Oct. 13, 1998

[54] EMBOSSING PRESS

[75] Inventor: Yeshayaou Balosh, Nirit, Israel

[73] Assignee: Balgo Products, Ltd., Nirit, Israel

[21] Appl. No.: 807,961

[22] Filed: Feb. 28, 1997

[30] Foreign Application Priority Data

Mar. 4, 1996 [IL] Israel ..... 117346

[51] Int. Cl.[6] ..... B31F 1/07

[52] U.S. Cl. ..... 101/31.1

[58] Field of Search ..... 101/31.1

[56] References Cited

U.S. PATENT DOCUMENTS

| | | | |
|---|---|---|---|
| 758,491 | 4/1904 | Woodman | 101/31.1 |
| 1,209,458 | 12/1916 | Leve | 101/31.1 |
| 1,411,892 | 4/1922 | Sonne et al. | 101/31.1 |
| 1,619,959 | 3/1927 | Sasseman | 101/31.1 |
| 2,906,197 | 9/1959 | Priesmeyer | 101/31.1 |
| 2,998,766 | 9/1961 | Priesmeyer | 101/31.1 |
| 3,177,801 | 4/1965 | Priesmeyer | 101/31.1 |
| 3,313,231 | 4/1967 | Priesmeyer et al. | 101/31.1 |
| 3,554,122 | 1/1971 | Priesmeyer et al. | 101/31.1 |
| 4,204,468 | 5/1980 | Harrison | 101/31.1 |

*Primary Examiner*—Edgar S. Burr
*Assistant Examiner*—Leslie Grohusky
*Attorney, Agent, or Firm*—I. Morley Drucker, Esq.; Fulwider Patton Lee & Utecht, LLP

[57] ABSTRACT

A paper or sheet material embossing press that uses snap-fit parts with a minimal use of bolts, rivets, welding, is disclosed. The embossing press has an embossing (or forward) end and rear end, and is constructed of a base frame having a lower arm extending from the rear end to the embossing end and having structure for supporting a lower die or die-holder at the embossing end. The embossing press further has a lever extending upwardly from the rear end and forwardly to a position over the embossing end, the lever supporting portion pivots yet has removably supported thereon the anchoring end of an operating lever. The embossing press has an operating lever having an anchoring end that is pivotally and removably supported by the lever supporting portion, a lower die to die-holder fixedly held in snap-fit engagement with the structure for supporting the lower die, an upper die or die-holder having an integral spring arm extending toward the rear end, the integral spring arm having a fixed end remote from the upper die, the integral spring arm serving to support the upper die above the lower die in a position to enable the upper die to be moved toward and away from the lower die, whereby by such movement brings their opposed faces into mating registry during an embossing operation.

24 Claims, 5 Drawing Sheets

FIG. 1
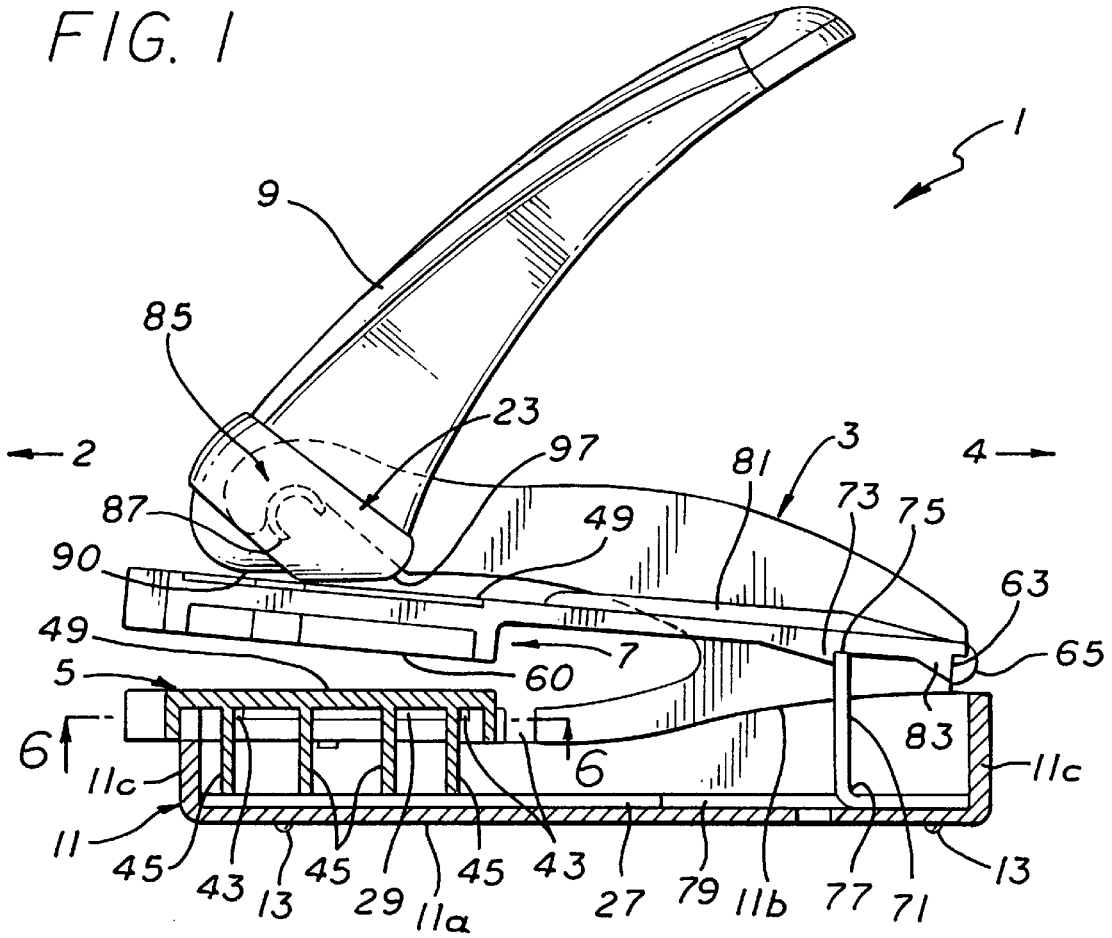
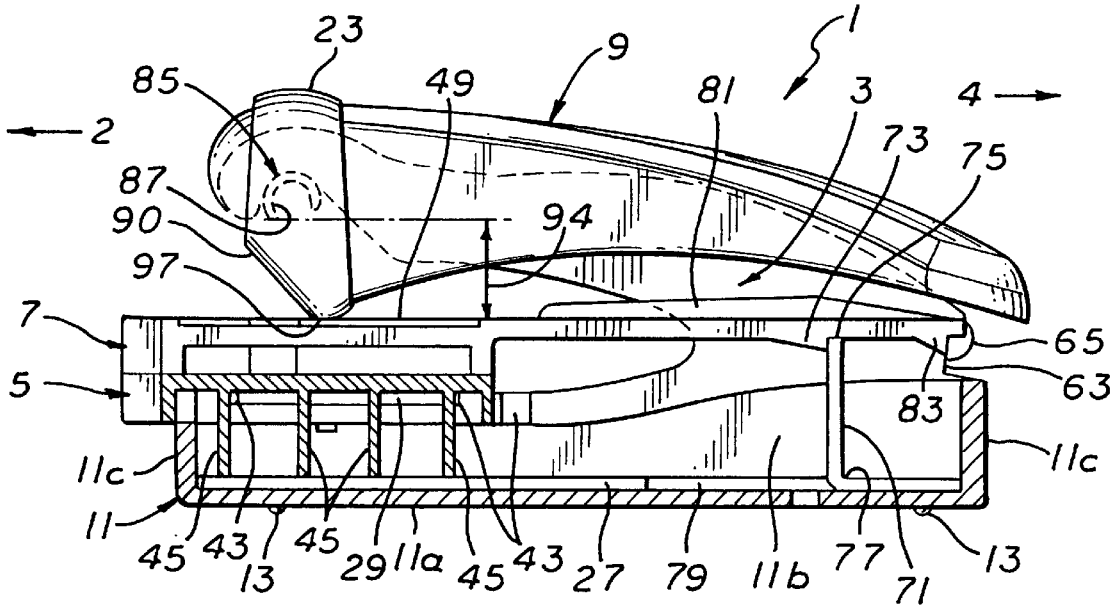
FIG. 2

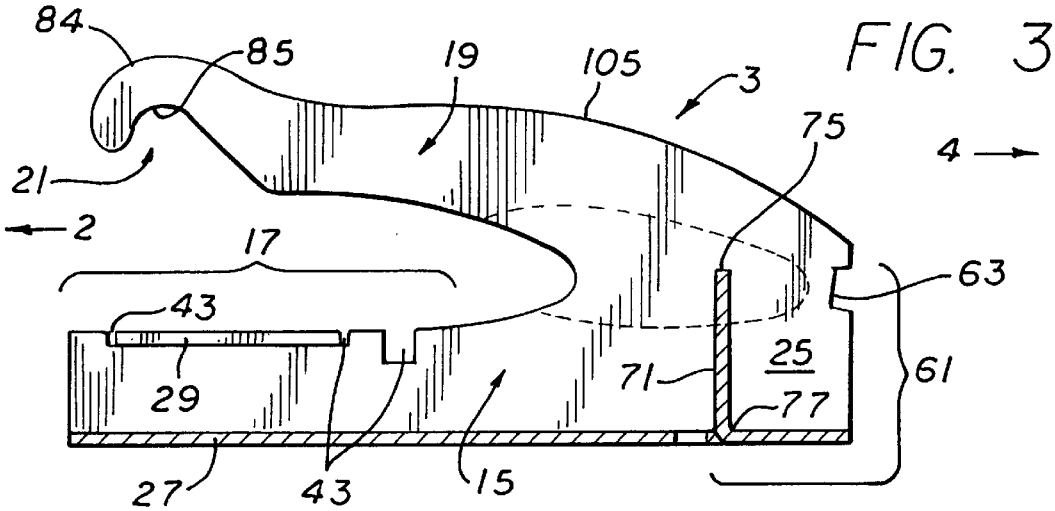
FIG. 3
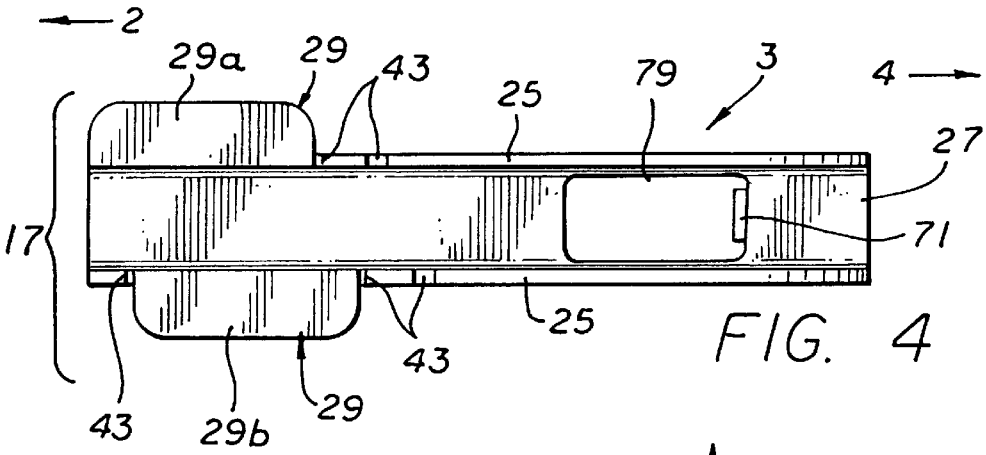
FIG. 4
FIG. 5
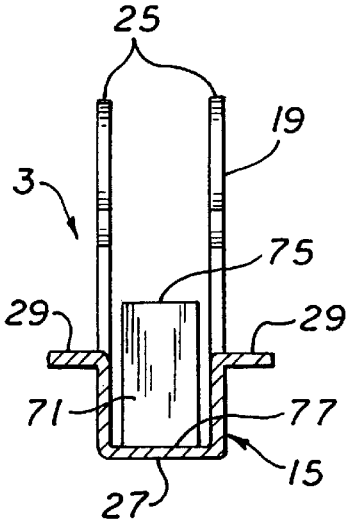
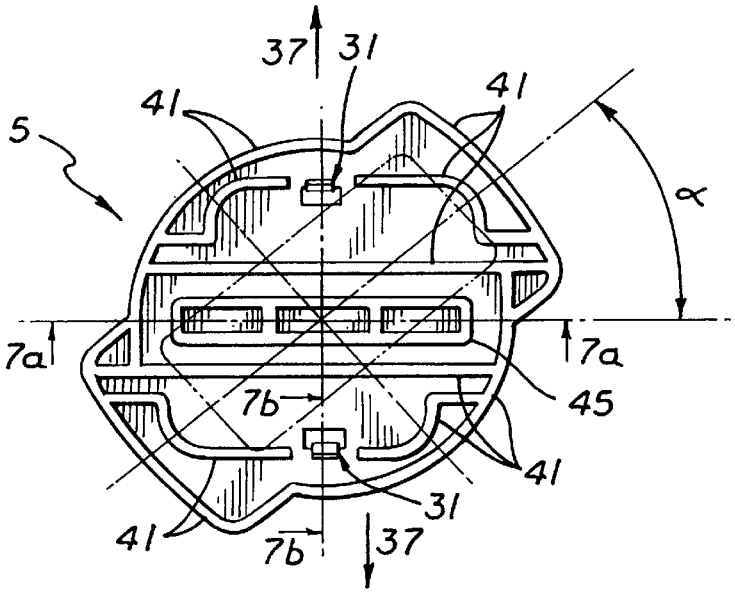
FIG. 6

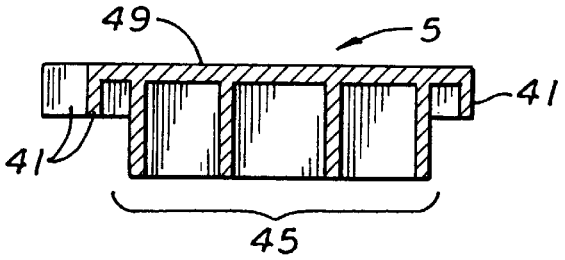
FIG. 7a
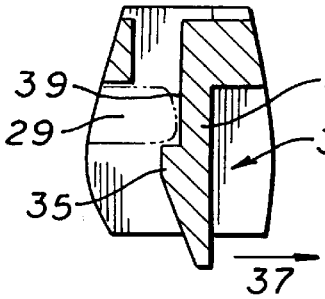
FIG. 7b
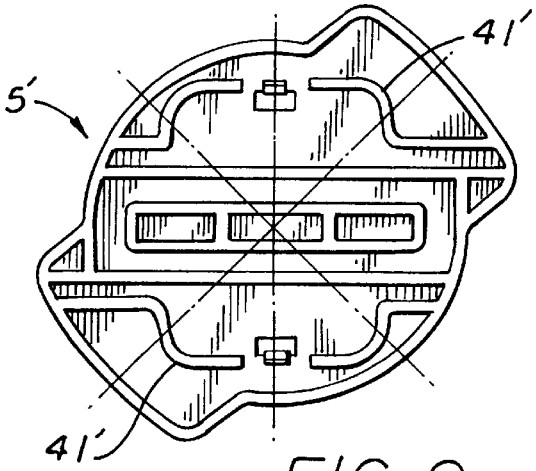
FIG. 9
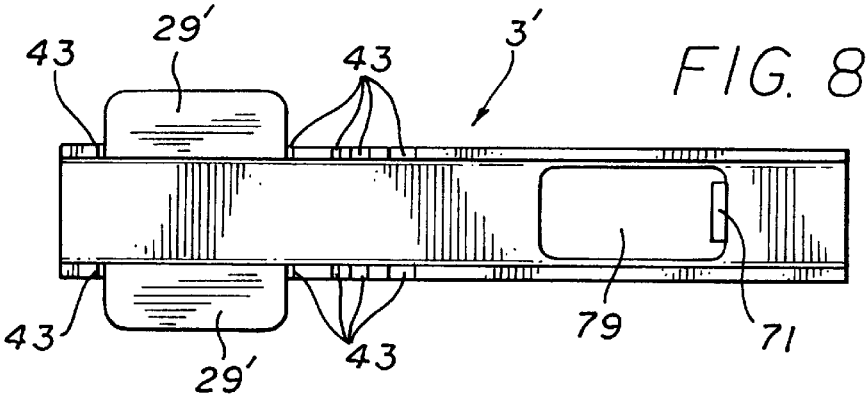
FIG. 8
FIG. 10
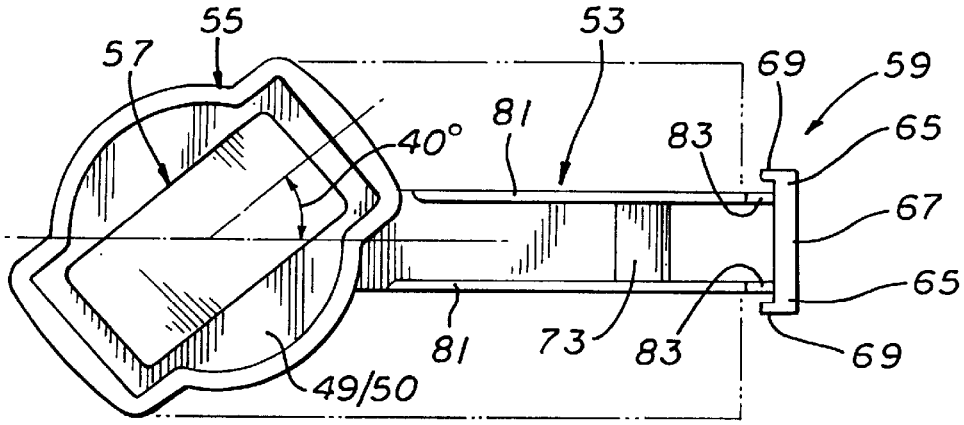

FIG. 11
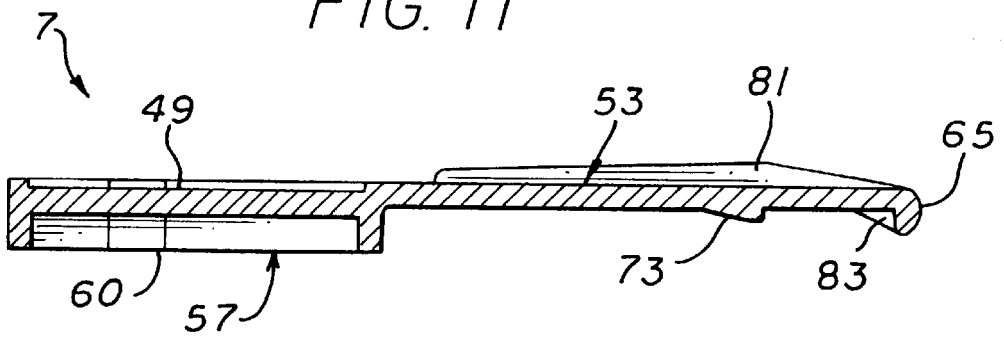
FIG. 12
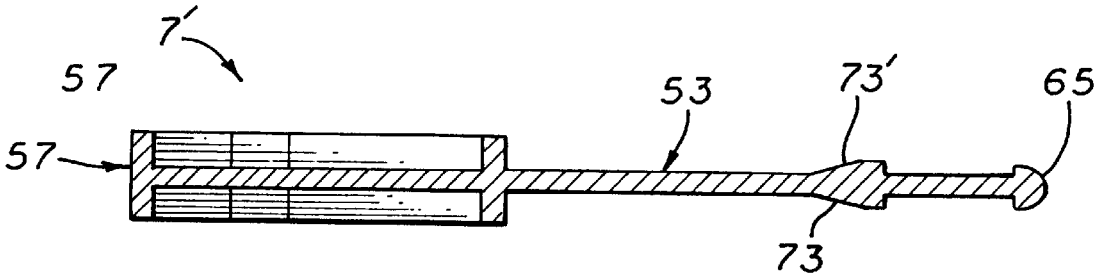
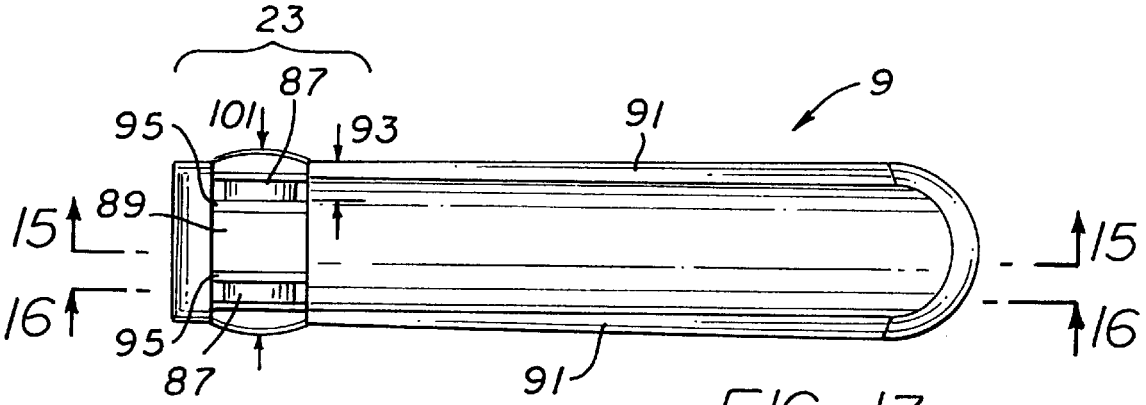
FIG. 13
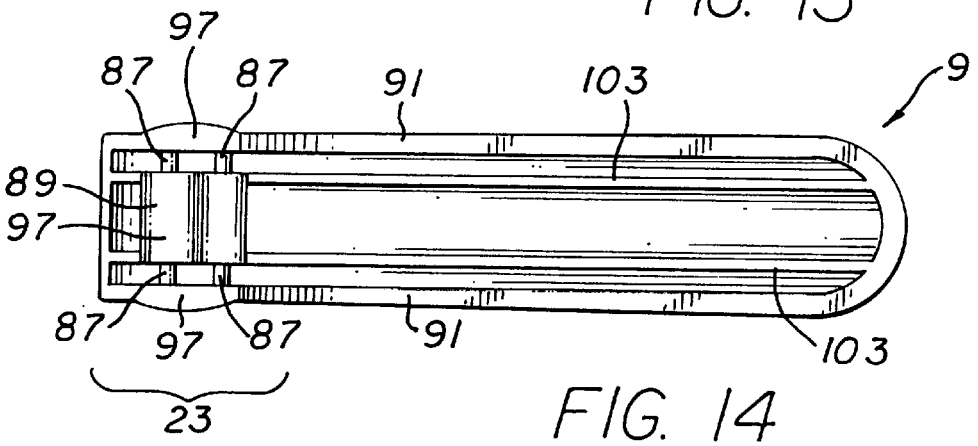
FIG. 14

FIG. 15
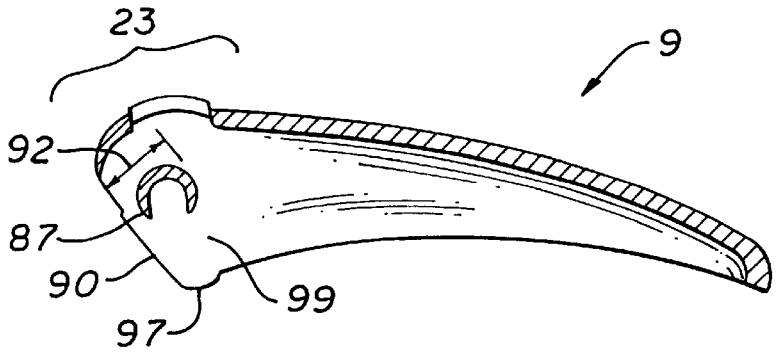
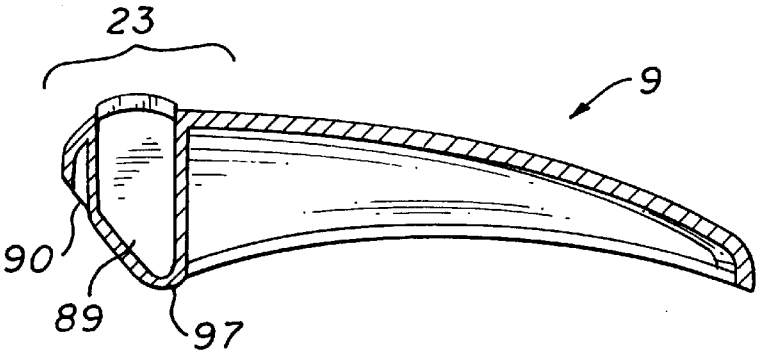
FIG. 16
FIG. 17a
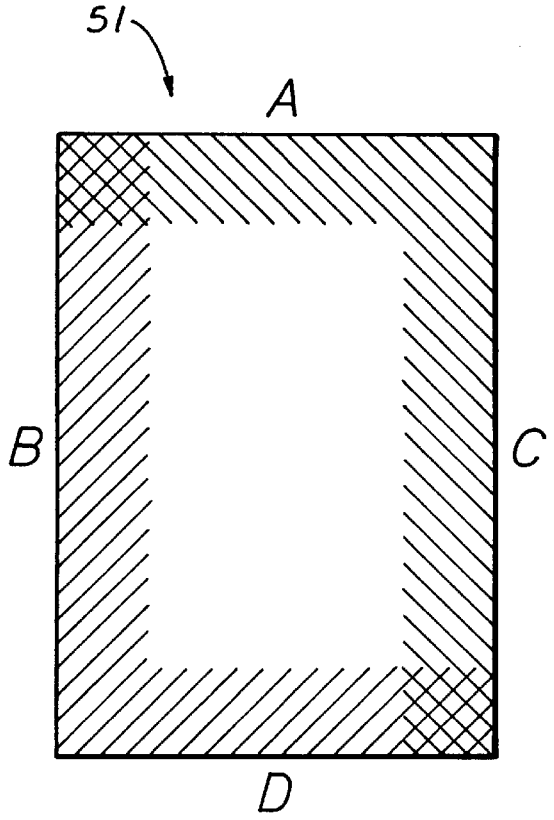
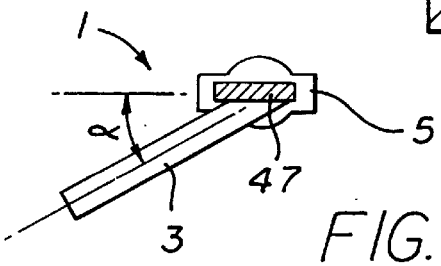
FIG. 17b

EMBOSSING PRESS

FIELD OF THE INVENTION

The present invention concerns hand operated embossing presses of the kind employed for embossing paper or other embossable sheet materials with company seals, governmental certification presses, notarial seals and the like.

BACKGROUND OF THE INVENTION

The production of embossing presses usually involves the assembling of several components together during the manufacturing process, whereby some of the components are comprised either of metals or plastics. The components commonly include a frame or shell or both, two dies or die-plates for providing the required embossing seal on the paper, a lever for pressing the dies against each other and some springer element for retaining the lever and the dies in a non-pressing state. One of the dies is usually rigidly mounted to the frame or the shell and the other is movably associated to the frame or shell to allow its pressing by the lever against the former die.

The pressing of a paper exerts high pressures upon the components of the embossing presses and therefore they are common sturdy and include a lot of metallic components which add extra weight to them. Moreover, the attachment together of the components is often carried out by elaborate attaching means such as welding, bolts, rivets and complex integral castings that hold up under the high pressures which are exerted thereupon as mentioned above. Therefore, the assembly of such embossing presses is relatively complicated, and their disassembly is often impossible.

In addition, most embossing presses are adapted to emboss a design or indicia only onto the top or only onto the bottom of a sheet of paper, but not onto both ends or onto the sides of the sheet. Several solutions were proposed to solve this problem, such as suggested in U.S. Pat. No. 1,411,892 to Sonne et al. or in U.S. Pat. No. 4,204,468 to Harrison. However, Sonne's patent teaches a structure of rotatable dies-plates which appears to be unreliable, cannot withstand high pressures and which manufacture is particularly labourious.

Harrison's Patent teaches the fixedly yet removably attaching of an upper die-plate holder to a springy member, which may be problematic with regard to the reliability and durability of the attachment. In addition, each time the embossment of two different sides of a paper is desired, it requires the tedious and elaborate removal and adversed attachment of the die-holders by the user. Moreover, the manufacture of Harrison's device involves many components and is complicated.

It is therefore, an object of the present invention, to provide a novel embossing press which overcomes the above described drawbacks of the devices known in the prior art.

In particular, objects of this invention is to provide an embossing press which is inexpensive to manufacture, involving a particularly small number of components, requires no use of rivets, bolts, welding and the like during manufacture except snap-fitting of components, simple to assembly and disassemble by manufacturer or by the unskilled user, reliable through repeated and intensive use, capable of sustaining high embossing pressures, lightweight, easy to operate, adapted to emboss adjacent sides of a sheet of paper without the necessity to remove any components, and to emboss the other two sides of the sheet of paper or a different design or indicia by simple displacement of displaceable components by the unskilled user.

These and other objectives are provided by the invention described below.

SUMMARY OF THE INVENTION

There is thus provided according to the present invention an embossing press for use in embossing paper or other embossable sheet materials with a desired pattern and having an embossing (or forward) end and rear end, the embossing press comprising (a) a base frame having an integral parts thereof
  (i) a lower arm extending from the rear end to the embossing end and having means for supporting a lower die or a die-holder at the embossing end, and
  (ii) upwardly extending from the rear end and forwardly to a position over the embossing end a lever supporting portion provided with means for pivotally yet removably supporting thereon the anchoring end of an operating lever, and (b) an operating lever having an anchoring end and being pivotally yet removably supported at the end by the lever supporting portion, (c) a lower die or die-holder fixedly held in snap-fit engagement with the means for supporting a lower die or a die-holder, (d) an upper die or die-holder comprising an integral spring arm extending toward the rear end, the integral spring arm comprising a fixed end remote from the upper die or die holder, the integral spring arm
  (i) serving to support the upper die or die-holder above the lower die or die-holder and in a position to enable the upper die or die-holder to be moved toward and away from the lower die-holder, whereby by such movement of the upper die or die-holder toward the lower die or die-holder their respective opposed faces are brought into mating registry during embossing operation; and
  (ii) the frame floor having as a unitarily integral part thereof a spring arm anchoring means, into which the spring arm is fixedly held in a snap-fit engagement and yet removably anchored thereto.

Preferably, the base frame comprises two opposed parallel side walls unitarily integral with and extending upwardly from a longitudinal floor along the bottom of the lower arm, whereby the lever supporting portion and the lower arm are comprised of the two side walls. Optionally, the base frame is comprised of stamped sheet metal bent into U-shaped form in its cross-section.

Further optionally, the means for supporting a lower die or a die-holder comprise outwardly extending flat ears to the edge of which meshing downwardly extending clasps mounted on the lower die or die-holder may snap-fitted engage yet removably disengage the lower die or die-holder to the ears. Optionally, the lower die-holder or upper die-holder may comprise an integral die. Preferably, the lower die-holder or upper die-holder are made of resilient plastic or POMM (i.e., acetal) or other relatively soft material.

Further preferably, the lower die-holder and upper die-holder are substantially inclined 40°–50° toward either side of the frame. To that aim, optionally, the ears may comprise one ear which is forwardly extended and another ear which is rearwardly extended, adapted to support the lower die or die-holder in permanent inclination of substantially 40°–50° toward one elected side of the frame. Preferably, the lower die-holder is adapted to be displaced in a 180° rotated position.

Optionally, the spring arm anchoring means comprise the combination of (a) two side recesses punched on the rear side of the frame and adapted to snap-fittedly yet removably receive two corresponding outwardly extending side protrusions mounted on the edge of the fixed end of the spring arm; and (b) a holding part in the shape of an upturned tongue into which the spring arm is fixedly held in a snap-fit engagement with the holding part and yet removably anchored thereto, by means of a lateral abutment bulging from and underneath the spring arm, in a position forwardly adjacent to the upper edge of the holding part.

Preferably, the holding part extends upwardly from the floor and the lower end of the holding part is integral with the floor.

Preferably, the means for pivotally yet removably supporting thereon the anchoring end of an operating lever include two curving portions of the side-walls at the top of the upper arm at the forward end and having downwardly directed and substantially concave recesses into which two transverse shanks of the lever may be inserted from underneath, the shanks are disposed between an intermediate cam portion of the lever and two side walls of the lever. Further preferably, the operating lever comprises an intermediate cam portion and two lever side walls, all of which are disposed in the vicinity of the anchoring end, the intermediate cam portion lever side walls are curving convexly downwardly. Optionally, the lever is unitarily casted plastic unit, and wherein the casting may include glass fibers, glass balls, minerals or organic filler.

Further features and advantages of the invention will be apparent from the description below, given by way of example only.

BRIEF DESCRIPTION OF THE INVENTION

The present invention will be further understood and appreciated from the following detailed description, taken in conjunction with the following enclosed drawings inwhich like numerals designate correspondingly analogous elements or sections throughout, and inwhich:

FIG. 1 is a longitudinal cross-sectional view of an embossing press, constructed and operative in according with one embodiment of the invention, with its operating lever shown in a raised position when the press is ready for insertion of paper or not in use;

FIG. 2 is a cross-sectional view of the embodiment of FIG. 1, with its operating lever shown in a depressed position when an embossing of a paper is taking place;

FIG. 3 is a side elevational view of the frame of the embodiment of FIG. 1;

FIG. 4 is a top plan view of the frame of FIG. 3;

FIG. 5 is a front end view of the frame of FIG. 3;

FIG. 6 is a cross sectional horizontal view of the die-holder of FIG. 1, taken along line A—A of FIG. 1;

FIG. 7*a* is a cross sectional side view of the die-holder of FIGS. 1 and 6, taken along line B—B of FIG. 6;

FIG. 7*b* is a fragmentary cross section of a clasp of the die-holder of FIGS. 1 and 6, taken along line E—E of FIG. 6;

FIG. 8 is a top plan view of an alternate frame of an embossing press, constructed and operative in accordance with another embodiment of the invention;

FIG. 9 is a cross sectional horizontal view of an alternate die-holder compatible to the frame of FIG. 8;

FIG. 10 is a top plan view of the upper die-holder of the embodiment of FIG. 1;

FIG. 11 is a side elevational view of the die holder of FIG. 10;

FIG. 12 is a side elevational view of an alternate die holder of an embossing press constructed and operative in accordance with a further embodiment of the invention;

FIG. 13 is a top plan view of the operating lever of the embodiment of FIG. 1;

FIG. 14 is a bottom plan view of the operating lever of the embodiment of FIG. 1;

FIG. 15 is a cross-sectional view of the operating lever of the embodiment of FIG. 1, taken along line C—C in FIG. 13;

FIG. 16 is a cross-sectional view of the operating lever of the embodiment of FIG. 1, taken along line D—D in FIG. 13;

FIG. 17 is a schematic demonstration of the embossing areas in a sheet of paper which is coverable by an embossing press constructed and operative in accordance with the invention.

DETAILED DESCRIPTION OF THE INVENTION

In reference to FIG. 1, there is shown an embossing press 1 for use in embossing paper or other embossable sheet materials with a desired pattern and which has an embossing (or forward) end 2 and rear end 4. Embossing press 1 comprises 4 basic components: base frame 3, lower die-holder 5, upper die holder 7, and operating lever 9. Optional housing 11 may be fixedly held in a snap-fit engagement and yet removably anchored to frame 3 in any known manner. Housing 11 comprises floor section 11*a*, longitudinal side walls 11*b*, and front and rear walls 11*c*. Optionally, leg buttons 13 may be attached to the bottom of frame 3 or to the floor section 11*a* for avoiding marring the surface over which embossing press 1 is used.

Housing 11 merely serves for decorative purposes, and is preferably made of plastics, either resilient or stiff, or rubber and may therefore be used for avoiding marring as well.

As best seen in FIGS. 3, 4 and 5, frame 3 comprises as integral parts thereof: (i) a lower arm 15 extending from rear end 4 to embossing end 2 and having means 17 for supporting the lower die-holder 5 at embossing end 2; (ii) upwardly extending from rear end 4 and forwardly to a position over embossing end 2 a lever supporting portion 19 provided with means 21 for pivotally yet removably supporting thereon the anchoring end 23 of operating lever 9. Preferably, frame 3 comprises two opposed parallel side walls 25 unitarily integral with and extending upwardly from longitudinal floor 27 along the bottom of lower arm 15, whereby lever supporting portion 19 and said lower arm 15 are comprised of the two side walls 25. Preferably, such base frame is comprised of stamped sheet metal bent into U-shaped form in its cross-section as apparatus in FIG. 5, the manufacture of which is relatively simple.

Lower die-holder 5 is fixedly held in a snap-fit engagement with means 17 designed for supporting lower die-holder 5. Means 17 comprise outwardly extending flat ears 29. To the edge of ears 29, meshing downwardly extending clasps 31 mounted on lower die-holder 5, as best seen in FIG. 6, may snap-fittedly engage yet removably disengage lower die-holder 5 to clasps 31. A detailed cross section of a clasp 31 is shown in FIG. 7*b*. Clasp 31 comprises a downwardly extending resilient upright 33 having an inwardly protruding abutment 35. Abutment 35 is tapered downwardly to facilitate gradual bending of upright 33 toward sideways 37 by ears 29, when die-holder 5 is pushed downwards over ears 29, until ears 29 arc tightly locked in recessed portion 39 above abutment 35 as in FIG. 7*b*, and keep die-holder 5 secured to lower arm 15. Die-holder 5 can be repeatedly removed and secured to lower arm 15 due to the resilient characteristics of clasps 31.

Referring again to FIG. 6, lower die-holder 5 preferably comprises vertical enforcement walls 41 mounted at its bottom. Enforcement walls 41 may circumscribe or surround ears 29 for guiding lower die-holder 5 in to place and provide further fixation of die-holder 5 in its predetermined positioning with regard to ears 29. Mating niches 43 in lower arm 15 into which walls 41 are inserted, provide for further support and guidance of die-holder 5. Further enhancement of the support of die-holder 5 may be provided by downwardly extending leg portion 45, the cross section of which is appearing in FIGS. 1 and 2 and is isolated in FIG. 7*a*. Leg portion 45 rests on floor 27 and supports the central part of die-holder 5. When a die 47 as shown in FIG. 6, is disposed on upper surface 49 of die-holder 5, as designated in FIGS. 1 and 2, die 47 is almost fully sustained against upper pressure by walls 41, leg 45 and ears 29. This configuration provides for the use of resilient plastic or POMM or other relatively resilient material for the manufacture of die-holder 5 with integral clasps 31, and possibly integral die 47, the manufacture of which is particularly simple and inexpensive.

It is often desirable to use the embossing press on different sides of a sheet of paper. For this purpose die-holder 5 is mounted in a horizontal inclination of substantially 40°–50° toward either side of frame 3, as designated by angle $\alpha$ in FIGS. 6 and 10. Referring now to FIG. 17, such positioning would allow embossing areas B and D in sheet 51 for a certain embossing pattern. Reversing of die 47 or its displacement in a 180° rotated position, would allow embossing areas A and C. Construction of embossing press 1 as a mirror image of the one shown in FIG. 1 would correspondingly allow embossing of areas A and B without reversal of die 47, and areas C and D after similar reversal of die 47.

In order to provide the above requirements while retaining the sustaining characteristics of the support of die 47, ears 29 may comprise one ear 29*a* which is forwardly extended and another ear 29*b* which is rearwardly extended, and so is adapted to support lower die 47 in permanent inclination angle $\alpha$ of substantially 40°–50° toward one elected side of frame 3. It may be appreciated by those skilled in the art that a preferable inclination angle $\alpha$ of 40° would still retain the ability to effectively emboss two adjacent sides of a sheet, as explained above in respect of FIG. 17, but will provide for better sustaining support of die 47 as apparent in FIG. 6.

If the support of die 47 is not crucial, for example—if die holder 5 comprises a particularly rigid surface 49, ears 29' of base frame 3' may be symmetrical with corresponding symmetrical walls 41' as in FIGS. 8 and 9. Such configuration allows the use of inclination of either side of frame 3 rather that one predetermined side.

With regard to the inclination of lower die-holder 5, upper die-holder 7 must be correspondingly inclined in respect of the axis of frame 3, as shown in FIG. 10. Upper die-holder 7 comprises an integral spring arm 53 extending toward rear end 4 and holder section 55. The manufacture of a combined upper-die holder 7 and a spring arm 53 is particularly simple and inexpensive, especially with the materials mentioned above in correlation to lower die-holder 5, and guarantees the durability of those parts and their connection through repeated embossments. Moreover, although an upper die 57 may be adhered to holder section 55, the structure of holder section 55 and lever 9 allows the manufacture of an integrated upper-die holder 7 which comprises integral die 57 and integral spring arm 53.

Integral spring arm 53 comprises a fixed end 59 remote from holder section 55. Spring arms 53 is serving to support upper holder section 55 above lower die-holder 5 and in a position to enable upper die-holder 7 to be moved toward and away from lower die-holder 5, whereby by such movement of upper die-holder 7 toward lower die-holder 5, their respective opposed faces (upper surface 49 and lower surface 60) are brought into mating registry during embossing operation as in FIG. 2.

Frame 3 has, as a unitarily integral part thereof, a spring arm anchoring means 61 in FIG. 3, into which said spring arm 53 is fixedly held in a snap-fit engagement and yet removably anchored thereto. Preferably, spring arm anchoring means 61 comprise the combination of: (a) two side recesses 63 punched on the rear side 4 of frame 3 and adapted to snap-fittedly yet removably receive two corresponding outwardly extending side protrusions 65 (shown in FIGS. 1, 2 and 10–12) mounted on edge 67 (in FIG. 10) of fixed end 59 of spring arm 53, whereby for enhancement of the grip of spring arm 53, protrusions 65 may comprise at their side edges forward extensions 69 (in FIG. 10); (b) a holding part 71 (in FIGS. 1–5) in the shape of an upturned tongue into which spring arm 53 is fixedly held in a snap-fit engagement with holding part 71 and yet removably anchored thereto, by means of a lateral abutment 73 bulging from and underneath spring arm 53, in a position forwardly adjacent to the upper edge 75 of holding part 71. Preferably, holding part 71 extends upwardly from floor 27 and the lower end 77 of holding part 71 is integral with floor 27. Such structure of holding part 27 is particularly easy to manufacture simply by cutting it out from floor 27 and bending it at the lower end 77. Niche 79 remains in floor 27, as best seen in FIG. 4, after the cutting out and bending of holding part 71 described above.

The above configuration provides for a simple installation and removal of die-holder 7 into frame 3. Spring arm 53 is inserted between walls 25, with protrusions 65 moved above lever supporting portion 19 until snugly fitted into recesses 63. Holder section 55 is simultaneously pulled below lever supporting portion 19 and abutment 73 eventually reaches edges 75 of holding part 71, and is snugly pushed to its tight grip as in FIG. 1. The resilience of spring arm 53 provides for the repeatable removal and installation of die-holder 7 in frame 3. When lower die holder 5 is rotated 180° or replaced, a matching upper die-holder 7 may be replaced.

Optionally, Spring arm 53 comprises upper enforcement side ribs 81 in FIGS. 1, 2, 10 and 11, for restraining its flexibility and enhancing its resilience. For similar purposes, lower side ribs 83 may be added at the edge 67 of spring arm 53 and connected to protrusions 65. However, since these ribs are not essential die holder 7' may be described to be a twofold die holder as in FIG. 12. Lateral abutment 73' is similar to lateral abutment 73 and allows the turning over of die-holder 7. Two alternate dies 57 may be installed on both sides of die-holder 7', provided, however, that dies 57 are of female type and are durable against marring by the action of lever 9 upon them.

Operating lever 9 has an anchoring end 23 and is pivotally yet removably supported at end 23 by means 21 of lever supporting portion 19. Optionally, means 21 may include two curving portions 84 (FIG. 3) of side-walls 25 at the top of lever supporting portion 19 and having downwardly directed and substantially concave recesses 85 into which two transverse shanks 87 of lever 9 may be inserted from underneath. As best seen in FIGS. 13 and 14, shanks 87 are disposed between an intermediate cam portion 89 and two side walls 91 of said lever and their width 93 is compatible to the thickness of portions 84 of frame walls 25. Thus, portions 84 are closely guided between the side walls 95 of cam portion 89 (FIG. 13) and side walls 91, and the movement or rotation of lever 9 is avoided.

The installment or removal of lever 9 may be simply carried out by means of its reciprocating downwards and upwards and its pushing and pulling to and from the front of embossing press 1, while maintaining the substantially flat surface 90 in a substantially horizontal positioning. Since width 92 (in FIG. 15) between surface 90 and the remote part of shank 87 is lesser than the gap 94 (in FIG. 2) between the lower external edge of portion 84 and the upper surface 49 of upper die-holder 7 in its depressed position, the installment and removal of lever 9 is possible.

The lower parts 97 of intermediate cam portion 89 and of side walls 91 in anchoring end 23 of lever 9 (FIG. 14) is curving convexly downwardly as shown in FIGS. 1, 2, 14 and 15. This structure allows the leveraged exertion of pressing force on upper die-holder 7 during depression of the operating lever 9 by the user in the position shown in FIG. 2. The curvature of parts 97 ensures minimal friction against the upper top surface 49 of holder section 55 (FIG. 1 2 and 11) during the process of depressing lever 9.

Further contribution to minimal friction may be achieved by the lubricating properties of POMM from which die-holder 7 may be produced, and by manufacturing lever 9 from materials differing from those comprising die-holder 7.

In order to provide broad pressing contact between lower parts 97 and upper surface 49 along die 57, the pressing contact is provided all along width 101 (FIG. 13) of lever 9 by parts 97, namely—walls 91 and cam 89, except the narrow spaces 99 (in FIG. 15) below shanks 87.

Lever 9 may comprise two longitudinal depending inner ribs 103 (FIG. 14) for its strengthening. Such structure is adaptable for the manufacture of lever 9, including all of its integral elements in anchoring end 23, as a unitary casted plastic unit, which is particularly simple and inexpensive. The casting may include as enforcing additives glass fibers, and other additives such as glass halls and minerals—which help to randomize the direction of the glass fibers, minerals which help to prevent distortions during the process of a cooled and shrinking of a casted plastic, or organic filler.

Operating lever 9 may be curving convexly upwardly as in FIGS. 1 and 2 and portion 19 may be correspondingly curved, such as edge 105 in FIG. 3. The geometry of portion 19 allows full depression of lever 9 to the position as in FIG. 2 on the one hand, but restraints any excess further depression which may damage the embossing press or the embossed sheet.

It will be appreciated by those skilled in the art that the invention is not limited to what has been shown and described hereinabove by way of example only Rather, the invention is limited solely by the claims which follow.

I claim:

1. An embossing press for use in embossing paper or other embossable sheet materials with a desired pattern and having an embossing end and a rear end, the embossing press comprising:

(a) a base frame having as integral parts thereof (i) a lower arm extending from said rear end to said embossing end and having means for supporting a lower die or a die-holder at said embossing end wherein said means for supporting has outwardly extending flat ears, and (ii) upwardly extending from said rear end and forwardly to a position over said embossing end a lever supporting portion provided with means for pivotally yet removably supporting thereon an anchoring end of an operating lever; and (b) an operating lever having an anchoring end and being pivotally yet removably supported at said anchoring end by said lever supporting portion, (c) a lower die or die-holder fixedly held in a snap-fit engagement with said means for supporting a lower die or a die-holder.

(d) an upper die or die-holder comprising an integral spring arm extending toward said rear end, said integral spring arm comprising a fixed end remote from said upper die or die holder, said integral spring arm (i) serving to support said upper die or die-holder above said lower die or die-holder and in a position to enable said upper die or die-holder to be moved toward and away from said lower die or die-holder, whereby such movement of the upper die or die-holder toward said lower die or die-holder their respective opposed faces are brought into mating registry during an embossing operation; and (ii) a frame floor having as a unitarily integral part thereof a spring arm anchoring means, into which said spring arm is fixedly held in a snap-fit engagement and yet removably anchored thereto.

2. An embossing press as in claim 1, wherein said base frame comprises two opposed parallel side walls unitarily integral with and extending upwardly from a longitudinal flour along the bottom of said lower arm, whereby said lever supporting portion and said lower arm are comprised of said two side walls.

3. An embossing press as in claim 1, wherein said base frame is comprised of stamped sheet metal bent into U-shaped form in its cross-section.

4. An embossing press as in claim 1, wherein said means for supporting a lower die or a die-holder further comprise outwardly extending flat ears to the edge of which meshing downwardly extending clasps mounted on said lower die or die-holder may snap-fittedly engage yet removably disengage said lower die or die-holder to said ears.

5. An embossing press as in claim 4, wherein said clasps comprise each a downwardly extending resilient upright having an inwardly protruding abutment which is tapered downwardly.

6. An embossing press as in claim 1, wherein at least one of said upper and lower die or die-holder comprises vertical enforcement walls mounted at its bottom.

7. An embossing press as in claim 6, wherein said enforcement walls surround said ears.

8. An embossing press as in claim 6, wherein said lower arm comprises mating niches into which said enforcement walls are inserted.

9. An embossing press as in claim 1, wherein at least one of said upper and lower die or die-holder comprises an integral downwardly extending leg portion which can rest on said frame floor and support the central part of said die-holder.

10. An embossing press as in claim 1, wherein said upper die or die holder comprise an integral die.

11. An embossing press as in claim 1, wherein said upper die or die-holder is made from a material selected from the group consisting of resilient plastic or acetal.

12. An embossing press as in claim 1, wherein said lower die-holder and upper die-holder are substantially 40°–50° inclined toward either side of said frame.

13. An embossing press as in claim 4, wherein said ears comprise one ear which is forwardly extended and another car which is rearwardly extended, adapted to support said lower die or die-holder in permanent inclination of substantially 40°–50° toward one elected side of said frame.

14. An embossing press as in claim 1, wherein said lower die-holder is adapted to be displaced in a 180° rotated position.

15. An embossing press as in claim 1, wherein said spring arm anchoring means comprise the combination of (a) two side recesses punched on the rear side of said frame and adapted to snap-fittedly yet removably receive two corresponding outwardly extending side protrusions mounted on the edge of said fixed end of said spring arm; and (b) a holding part in the shape of an upturned tongue into which said spring arm is fixedly held in a snap-fit engagement with said holding part and yet removably anchored thereto, by means of a lateral abutment bulging from and underneath said spring arm, in a position forwardly adjacent to the upper edge of said holding part.

16. An embossing press as in claim 15, wherein said protrusions comprise forward extensions at their side edges.

17. An embossing press as in claim 15, wherein said holding part extends upwardly from said floor and the lower end of said holding part is integral with said floor.

18. An embossing press as in claim 2, wherein said means for pivotally yet removably supporting thereon the anchoring end of an operating lever include: two curving portions of said side-walls at the top of said upper arm at the said forward end and having downwardly directed and substantially concave recesses; two transverse shanks of said lever may be inserted from underneath; an intermediate cam portion of said lever; and two side walls of said lever wherein said shanks are disposed between said intermediate cam portion and said two side walls.

19. An embossing press as in claim 1, wherein said operating lever comprises an intermediate cam portion and two lever side walls, all of which are disposed in the vicinity of said anchoring end, said intermediate cam portion lever side walls are curving convexly downwardly.

20. An embossing press as in claim 1, wherein said lever comprises two longitudinal depending inner ribs.

21. An embossing press as in claim 1, wherein said lever is a unitarily cast plastic unit, and wherein said casting includes a material selected from the group consisting of: glass fibers, glass balls, minerals or organic filler.

22. An embossing press as in claim 1, wherein said lever curves convexly upwardly and is curved at its top.

23. An embossing press for use in embossing paper or other embossable sheet materials with a desired pattern and having an embossing end and rear end, the embossing press comprising:

(a) a base frame having as integral parts thereof (i) a lower arm extending from said rear end to said embossing end and having means for supporting a lower die or a die-holder at said embossing end wherein said means for supporting has outwardly extending flat ears, and (ii) upwardly extending from said rear end and forwardly to a position over said embossing end a lever supporting portion provided with means for pivotally yet removably supporting thereon an anchoring end of an operating lever; and (b) an operating lever having an anchoring end and being pivotally yet removably supported at said anchoring end by said lever supporting portion, (c) a lower die or die-holder fixedly held in a snap-fit engagement with said means for supporting a lower die or a die-holder, (d) an upper die or die-holder comprising an integral spring arm extending toward said rear end, said integral spring arm comprising a fixed end remote from said upper die or die holder, said integral spring arm (i) serving to support said upper die or die-holder above said lower die or die-holder and in a position to enable said upper die or die-holder to be moved toward and away from said lower die or die-holder, whereby by such movement of the upper die or die-holder toward said lower die or die-holder their respective opposed faces are brought into mating registry during an embossing operation;

(ii) a frame floor having as a unitarily integral part thereof a spring arm anchoring means, into which said spring arm is fixedly held in a snap-fit engagement and yet removably anchored thereto; and (iii) said upper die or die-holder and said integral spring arm are made of a material selected from the group consisting of resilient plastic or Acetal.

24. An embossing press as in claim 23, wherein said upper die or die-holder comprises an integral die.

* * * * *

UNITED STATES PATENT AND TRADEMARK OFFICE

CERTIFICATE OF CORRECTION

PATENT NO. : 5,819,647

DATED : Oct. 13, 1998

INVENTOR(S) : Yeshayaou Balosh

It is certified that error appears in the above-identified patent and that said Letters Patent is hereby corrected as shown below:

Column 5, line 53, change "5", to read --5'--.

Column 5, line 53, after "rigid", insert --upper--.

Column 5, line 57, change "3", to read --3'--.

Column 7, line 28, between "1" and "2", insert --,--.

Signed and Sealed this

Twenty-sixth Day of January, 1999

*Attest:*

*Attesting Officer*

*Acting Commissioner of Patents and Trademarks*